United States Patent [19]

Bates

[11] 4,364,189

[45] Dec. 21, 1982

[54] RUNNING SHOE WITH DIFFERENTIAL CUSHIONING

[76] Inventor: Barry T. Bates, 3809 Monroe St., Eugene, Oreg. 97405

[21] Appl. No.: 213,207

[22] Filed: Dec. 5, 1980

[51] Int. Cl.[3] ..... A43B 13/16; A43B 21/32; A43B 5/00

[52] U.S. Cl. ..... 36/31; 36/29; 36/30 R; 36/37; 36/129

[58] Field of Search ..... 36/31, 32 R, 30 R, 43, 36/44, 37, 29, 129, 114; 128/581, 583–585

[56] References Cited

U.S. PATENT DOCUMENTS

| | | | |
|---|---|---|---|
| 1,428,356 | 9/1922 | Brown . | |
| 1,432,961 | 10/1922 | Brown . | |
| 2,001,821 | 5/1935 | Everston | 36/28 |
| 2,099,418 | 11/1937 | Bradley et al. | 36/11.5 |
| 2,678,506 | 5/1954 | Baroumes | 36/8.5 |
| 2,694,871 | 11/1954 | Rollman | 36/14 |
| 2,983,056 | 5/1961 | Murawski | 36/29 |
| 3,594,929 | 7/1971 | Stohr | 36/44 |
| 3,892,077 | 7/1975 | Wolstenholme et al. | 36/44 |
| 4,079,526 | 3/1978 | Fukuoka | 36/30 |
| 4,180,924 | 1/1980 | Subotnick | 36/129 |
| 4,187,621 | 2/1980 | Cohen | 36/44 |
| 4,235,026 | 11/1980 | Plagenhoef | 36/32 R |
| 4,236,326 | 12/1980 | Inohara | 36/29 |
| 4,302,892 | 12/1981 | Adamik | 36/31 |

FOREIGN PATENT DOCUMENTS

| | | | |
|---|---|---|---|
| 2709546 | 9/1978 | Fed. Rep. of Germany | 36/44 |
| 2751146 | 5/1979 | Fed. Rep. of Germany | 36/31 |
| 2806481 | 8/1979 | Fed. Rep. of Germany | 36/31 |
| 2904540 | 8/1980 | Fed. Rep. of Germany | 36/129 |
| 828437 | 2/1938 | France | 36/32 R |

*Primary Examiner*—James Kee Chi

*Attorney, Agent, or Firm*—Kolisch, Hartwell & Dickinson

[57] ABSTRACT

A sports running shoe constructed to minimize impact shock and to maximize lateral stability. The shoe's midsole is formed with a medial layer portion having one overall firmness, and a lateral layer portion having a lesser overall firmness.

5 Claims, 7 Drawing Figures

RUNNING SHOE WITH DIFFERENTIAL CUSHIONING

BACKGROUND AND SUMMARY

The present invention relates to sports shoes, and in particular, to a running shoe constructed to minimize impact shock and to maximize lateral stability.

Extensive clinical evaluation of foot and knee injuries sustained by runners and joggers suggests that the most important factors associated with such injuries are shock absorption on impact and lateral foot stability. Based on injury data, these two factors appear to be of about equal importance. Therefore, both factors should be considered in proposing improvements in sports shoes.

For most runners, initial foot impact occurs in the heel region. Heel cushioning material, which is contained principally in the shoe's midsole of a running shoe has a firmness which provides proper impact cushioning for a person of about average weight. Where the runner is quite heavy, the heel cushioning material may "bottom out" before heel impact is completely absorbed, and shock-related injuries can result. On the other hand, poor lateral foot stability may result in conventionally constructed running shoes if the cushioning material is too soft.

Lateral foot stability refers to a shoe's ability to control the normal tendency of a foot to roll toward its inside on impact. Ideally this inward rolling of the foot, which is known as pronation, is arrested about when the knee is maximally flexed. Where the foot continues pronation after the knee reaches its maximum flexion and has begun to straighten, cumulative knee strain leading to knee injury may occur. As a general rule, prior art running shoes having a relatively firm midsole, particular in the heel region, provide the best lateral stability.

One general object of the present invention is to provide a running shoe having both good shock absorption and lateral stability characteristics.

A more specific object is to provide such a shoe in which the runner's weight, during initial impact, is transferred from softer to firmer cushioning material, to provide effective shock absorption in both light and heavy runners.

Still another object is to provide such a shoe which is constructed to increase lateral foot stability without sacrifice in shock absorption characteristics.

The sports shoe of the present invention includes a sole layer which is formed of an inner side layer portion having one overall firmness and an outer side layer portion having a lesser overall firmness. In one embodiment of the invention, the layer portions are located substantially in the heel region of the layer. In another embodiment, such portions extend substantially throughout the length of the layer.

These and other objects and features of the present invention will become more fully apparent when the following detailed descriptions of preferred embodiments of the invention are read in conjunction with the accompanying drawings, wherein.

DETAILED DESCRIPTION OF THE INVENTION

Figure 1:
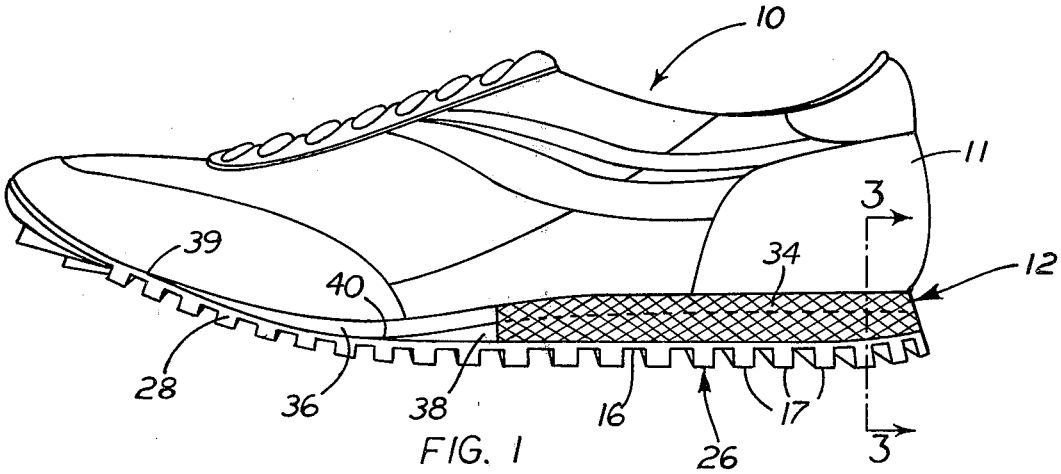
FIG. 1 is a side view of a sports shoe having a midsole constructed according to one embodiment of the present invention.

In FIG. 1 there is shown at 10 a sports shoe constructed according to one embodiment of the invention. Shoe 10 includes a soft foot covering 11 secured to the upper surface of a midsole 12 which joins on its bottom side with an outsole 16. The outsole includes on its base a conventional pattern of generally wedge-shaped lugs, such as lugs 17, which are separated by generally wedge-shaped spaces.

Figure 2:
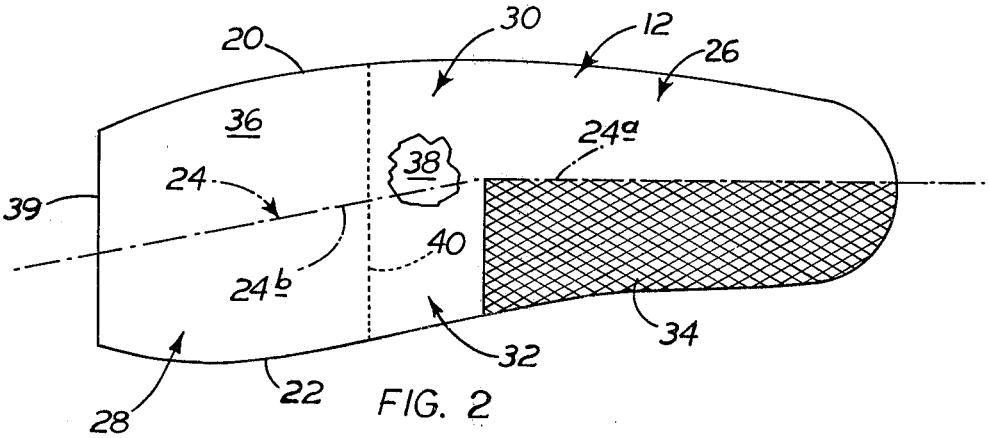
FIG. 2 illustrates, in top plan view, the midsole of the shoe of FIG. 1, removed from the shoe.
Figure 3:
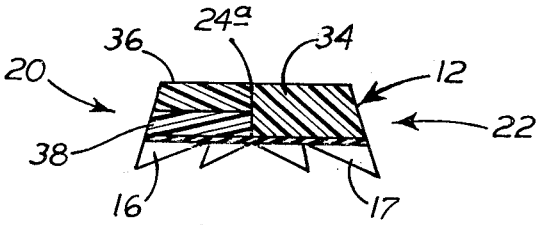
FIG. 3 is a sectional view taken along line 3—3 in FIG. 1 further illustrating the shoe's midsole with the same joined to an outsole.

With reference to FIGS. 2 and 3, the shoe, and particularly midsole 12 has an outer, or lateral, side 20 and an inner, or medial, side 22. What might be thought of as an angled longitudinal midline axis in the shoe, indicated by dash-dot line 24 in FIG. 2, extends along the length of the shoe substantially midway between sides 20, 22. Axis 24 includes a heel axis segment **24*a* which substantially bisects the heel region of the shoe, here indicated at 26, and a forefoot axis segment 24*b* substantially bisecting the forefoot region of the shoe, which is indicated in FIG. 2 at 28. The shoe expanses on outer and inner sides of axis 24 (upper and lower sides of this axis in FIG. 2) are denoted herein as outer and inner lateral side expanses 30, 32**, respectively.

Midsole 12 includes an elastomeric slab portion 34 having the planar shape indicated by cross-hatch shading in FIG. 2, and corresponding roughly to the inner side expanse in the heel region of the shoe. Portion 34, as it appears from the side of the shoe, is indicated also by cross-hatch shading in FIG. 1. As can be appreciated in FIG. 3, the interior edge of portion 34 occupies a vertical plane with the shoe in its normal position, with this plane containing axis segment **24*a***.

Portion 34, which is also referred to herein as an inner resilient layer portion, is preferably formed of a foamed elastomeric material such as polyurethane. The overall firmness in such material is generally directly related to the material's density. A typical density in portion 34 is one which produces an overall firmness, as measured by a conventional durometer scale of between about 70 and 80-Shore.

Forming the remainder of midsole 12 are upper and lower somewhat L-shaped midsole layers 36, 38, respectively. Layer 36, which has the planar shape shown by the unshaded region of the midsole in FIG. 2, tapers in thickness toward a front end 39 adjacent the toe of the shoe, as can be seen in FIG. 1. Layer 38, which terminates at a forward end 40 in FIGS. 1 and 2, has the same planar dimensions as that portion of layer 36 which is to the right of end 40 in FIG. 2. Referring to FIG. 3, the interior edges of layers 36, 38, in the heel region of the shoe, abut layer 34 along the above-mentioned vertical plane. The portions of layers 36, 38 coextensive with portions 34 in the heel section of the shoe are also referred to herein, collectively, as an outer resilient layer portion and as an elastomeric slab portion.

Midsole layers 36, 38 are preferably formed of a foamed elastomeric material such as polyurethane. According to an important feature of the embodiment of the invention now being described, layers 36, 38, particularly in the heel region of the shoe, have an overall firmness which is substantially less than that of portion 34. Specifically, layers 36, 38 have densities which produce durometer readings in the range of between about 30 and 35-Shore and about 35 and 45-Shore, respectively. It should be recalled that the durometer reading for portion 34 is about twice these values.

Let us consider now how shoe 10 performs. Perhaps a good way to begin this explanation is to describe generally the mechanics of a "typical" running footfall, and to explain what is meant by shock absorption and lateral stability. The term "typical", as used in the preceding sentence, was placed in quotation marks to reflect the fact that no two footfalls, even with the same runner, are exactly identical.

Considering the fall of a person's right foot during running, the footfall begins with an impact (through a shoe) between the underlying surface and the lateral side of a person's heel. As the footfall progresses, there is an inward rolling of the foot, relative to the axis of the leg, toward the medial side of the foot, and there is a further impact between the underlying surface and the forefoot region of the foot. Thereafter, the foot continues by lifting from the surface.

Shock to the foot, ankle, and leg is considered herein to be substantially vertically directed, and is directly proportional to the rate of vertical deceleration which the foot experiences during a footfall. Sequential impacting of first the lateral heel region in a foot, and thereafter the forefoot region, results in what might be thought of as a dual-peak shock-transmission situation. In other words, vertical foot deceleration tends to maximize in concurrence with these two events. Accordingly, shock absorption and reduction is directly attainable by minimizing the peaks in such peak deceleration.

After the foot has first struck the ground, and when the same begins pronation, there occurs a somewhat oscillatory lateral force transmission between the foot and the underlying surface. In other words, such force transmission will at one moment be directed laterally outwardly, and in another moment medially, and so on. The kind of lateral instability which is considered to be potentially damaging, and which is sought to be avoided, results directly from the degree of pronation which occurs. The greater the amount of pronation, the greater the energy which is absorbed angularly in the ankle, the lesser is the lateral force transmission to the underlying surface, and the greater the instability. Conversely, the lower the amount of pronation, the lower the amount of energy angularly which is absorbed in the ankle, the greater is the force transmission to the underlying surface, and the greater is the stability. Thus, an effort to maximize lateral stability is one which seeks to minimize pronation and to maximize lateral force transmission to the ground during a footfall.

From the discussion above, it will be apparent that the performance of a shoe during running to minimize shock and lateral stability can be evaluated from force measurements which are made during a runner's footfalls. In a manner which will now be described, such measurements have been made in rather substantial detail with respect to a shoe constructed like shoe 10, as well, in a comparative sense, with respect to several currently available conventional running shoes.

The testing data which appears in the tables below was obtained from the performances of five different subjects, all of them regular runners, wearing each of four different types of shoes. The shoes in the tables are simply identified by Arabic numbers. Shoe-1 was one manufactured by Osaga, Inc., 2468 West 11th, Eugene, Oregon, identified as a model number KT-26. Shoe-2 was exactly the same shoe, except that it was modified in its midsole in accordance with the description above of midsole 12 in shoe 10. Shoe-3 was one manufactured by Nike, Inc., Beaverton, Oregon, and sold under the trade designation Tailwind. Shoe-4 was one made by Adidas, Sportschuhfabricken, 8522 Herzogenaurach, West Germany, Postfach 1120, sold as model number TR-X.

The experimental set up for obtaining data included a conventional force platform interfaced in a well known manner with a conventional computer and with a suitable graphics display system. An acceptable test required that each runner contact the force platform in a normal stride pattern at a designated pace, which was controlled between a 6½ and a 7½ minute mile pace using a photoelectric timing system. Platform contact force recording was triggered automatically by the computer.

Tables, I, II and III below relate to shock absorption. Table I, which is entitled "First Maximum Vertical Force Values", includes data obtained from initial lateral heel impact with the platform. Table II, which is labeled "Second Maximum Vertical Force Values", reflects data obtained from forefoot region impact with the platform. Table III shows average vertical force values throughout the total foot platform contact period. The force values presented in these three tables are in normalized units of Newton's per kilogram of subject body mass.

TABLE I

| | First Maximum Vertical Force Values | | | |
|---|---|---|---|---|
| Subject | Shoe-1 | Shoe-2 | Shoe-3 | Shoe-4 |
| 1 | 20.3 | 13.4 | 20.0 | 11.3 |
| 2 | 17.6 | 17.4 | 19.5 | 18.0 |
| 3 | 12.8 | 11.5 | 13.0 | 12.1 |
| 4 | 15.2 | 16.1 | 13.1 | 17.1 |
| 5 | 15.2 | 15.2 | 16.1 | 12.8 |
| Mean | 16.4 | 14.7 | 16.3 | 14.3 |

TABLE II

| | Second Maximum Vertical Force Values | | | |
|---|---|---|---|---|
| Subject | Shoe-1 | Shoe-2 | Shoe-3 | Shoe-4 |
| 1 | 27.8 | 15.8 | 26.0 | 15.1 |
| 2 | 25.1 | 25.0 | 26.4 | 26.2 |
| 3 | 14.0 | 11.9 | 14.9 | 14.2 |
| 4 | 14.1 | 14.1 | 12.5 | 17.6 |
| 5 | 25.1 | 24.4 | 24.3 | 24.2 |
| Mean | 21.2 | 18.2 | 20.8 | 19.5 |

TABLE III

| | Average Vertical Force Values for Total Support Period | | | |
|---|---|---|---|---|
| Subject | Shoe-1 | Shoe-2 | Shoe-3 | Shoe-4 |
| 1 | 15.5 | 8.7 | 14.3 | 8.6 |
| 2 | 14.7 | 14.3 | 15.4 | 15.5 |
| 3 | 8.0 | 6.8 | 8.7 | 8.3 |

TABLE III-continued

| Average Vertical Force Values for Total Support Period | | | | |
|---|---|---|---|---|
| Subject | Shoe-1 | Shoe-2 | Shoe-3 | Shoe-4 |
| 4 | 8.2 | 8.3 | 7.5 | 10.6 |
| 5 | 14.2 | 14.0 | 14.4 | 14.2 |
| Mean | 12.1 | 10.4 | 12.0 | 11.4 |

In each column of Tables I, II and III, which column pertains to a particular one of the four different tested shoes, there are six data numbers. The first five are the normalized force values measured for each of the five different runners. The sixth and lowest number in each column is the mean number for the column. Referring particularly to the mean numbers presented in these three tables, in table I it is seen that shoes 2 and 4 are closely competitive, and are significantly better heel-impact shock absorbers than shoes 1 and 3. In Table II, the mean numbers clearly indicates superiority of shoe-2 for forefoot impact shock absorption.

The average mean values presented in Table III confirm shoe-2 as being superior in overall shock-absorption characteristics.

Tables IV and V below relate to lateral stability. Table IV which is entitled "Average Medial/Lateral Force Values for 15-45% of Support Period" indicates the direction and magnitude of maximum normalized side-directed forces occuring during the first 15%-45% of the total foot contact time. Table V which is entitled "Average Medial/Lateral Force Values for 30-60% of Support Period" is similar to Table IV, except that it relates to a different particular span of the overall foot-contact time period.

TABLE IV

| Average Medial/Lateral Force Values for 15-45% of Support Period | | | | |
|---|---|---|---|---|
| Subject | Shoe-1 | Shoe-2 | Shoe-3 | Shoe-4 |
| 1 | −70 | −50 | −29 | −5 |
| 2 | 4 | −48 | −95 | −44 |
| 3 | 52 | 71 | 45 | 63 |
| 4 | −35 | −40 | 4 | −24 |
| 5 | 5 | −4 | 48 | 44 |
| Mean | −9 | −14 | −5 | 7 |

TABLE V

| Average Medial/Lateral Force Values for 30-60% of Support Period | | | | |
|---|---|---|---|---|
| Subject | Shoe-1 | Shoe-2 | Shoe-3 | Shoe-4 |
| 1 | −157 | −116 | −104 | −78 |
| 2 | −49 | −104 | −170 | −134 |
| 3 | −28 | −22 | −57 | −41 |
| 4 | −99 | −92 | −90 | −120 |
| 5 | −27 | −22 | −4 | −5 |
| Mean | −68 | −71 | −85 | −56 |

It can be seen that in these two tables both positive and negative force values are recorded. The algebraic signs of these values is simply an indication of the direction in which the recorded forces were applied.

Recalling that maximum lateral force transmission indicates minimal pronation and maximum lateral stability, Table IV, and with reference to the mean force values presented in this table, indicates clear lateral stability superiority in shoe-2. In Table V, shoe-3 appears to be somewhat superior to shoe-2, with both of these shoes being superior in lateral stability performance vis-a-vis shoes 1 and 4.

What the data in these two tables indicates is that, shoe-2 provides significant lateral stability in comparison with the other tested shoes.

Recognizing, as one must, that there is no single running-shoe design which is superior in all respects under all conditions for all runners, test data developed in the comparisons just discussed indicates that a shoe constructed along the lines of shoe 10 tends to produce overall better-shoe performance. In other words, such construction tends to maximize both shock absorption and lateral stability.

Figure 4:
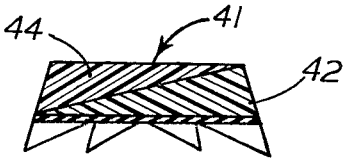
FIG. 4 is a view similar to FIG. 3 showing another embodiment of a running shoe midsole as contemplated by the present invention.

Continuing with a description of what is shown in the drawings, FIG. 4 illustrates, in a cross-sectional view similar to that presented in FIG. 3, a midsole 41 constructed in accordance with another embodiment of the invention. As in FIG. 3, the medial side of the midsole is on the right side of FIG. 4. The heel region in midsole 41 is formed of a pair of slab portions 42, 44 having the cross-sectional shapes illustrated in FIG. 4, with each slab having substantially the same longitudinal extents as portion 34 in FIG. 2. Slab portions 42, 44 meet along a planar interface which slopes downwardly toward the outer side of the shoe. Portion 42 has a density and firmness similar to that of portion 34. Portion 44 has a density and firmness similar to those of previously mentioned layers 36, 38.

A shoe constructed in accordance with FIG. 4 performs with substantially the same overall improved shock absorption and lateral stability characteristics described above for shoe 10.

Figure 5:
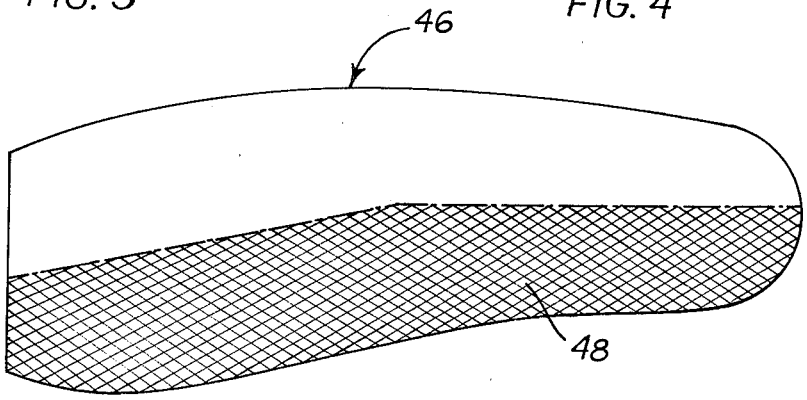
FIG. 5 is a view similar to FIG. 2, illustrating still another embodiment of a midsole contemplated by the present invention.

FIG. 5 shows a midsole 46 constructed according to yet another embodiment of the invention. In midsole 46, a slab portion 48, similar in firmness and density to previously mentioned portion 34 in midsole 12, extends along the full length and depth of the midsole. This portion is distinguished in FIG. 5 by cross-hatch shading. The unshaded portion of midsole 34 has a density and firmness similar to those of layers 36, 38 in midsole 12.

A shoe constructed in accordance with FIG. 5 also performs, in an overall sense, with greatly enhanced shock absorption and lateral stability characteristics.

Figure 6:
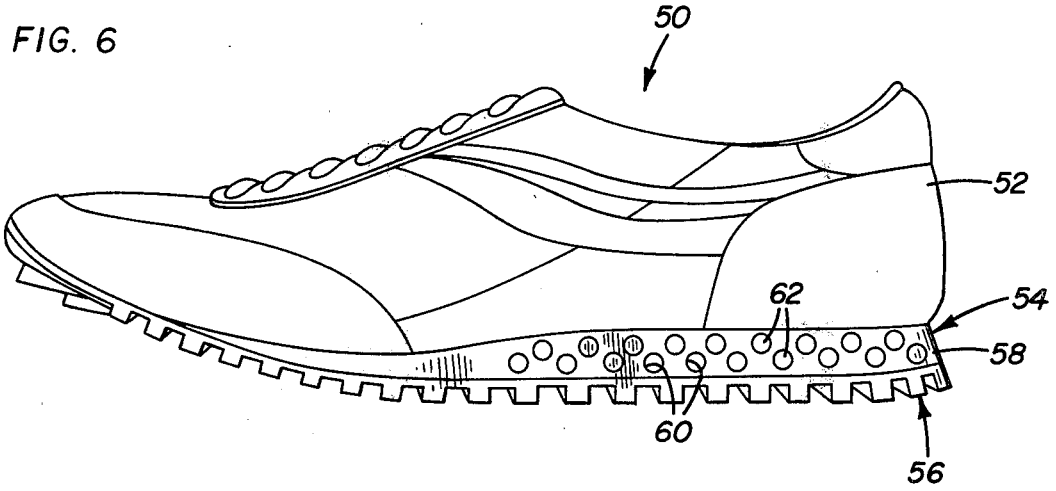
FIG. 6 is a side view, similar to FIG. 1, showing a sports shoe having a midsole constructed in accordance with yet another embodiment of the present invention.
Figure 7:
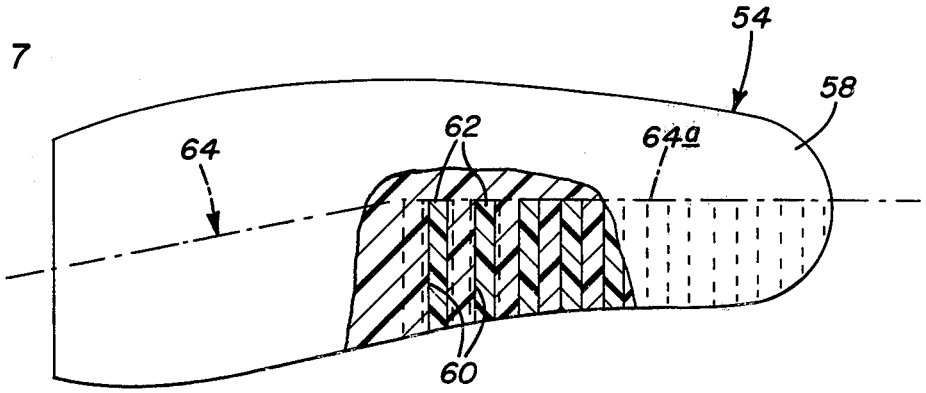
FIG. 7 is a view similar to FIG. 2 illustrating, in top plan view, the midsole of the shoe of FIG. 6, removed from the shoe.

Describing now still another modification of the present invention, the same is shown in FIGS. 6 and 7. In FIG. 6, a shoe, which is similar in many respects to shoe 10, is shown generally at 50. Like shoe 10, shoe 50 includes a soft foot covering 52 secured to the upper surface of a midsole 54 which joins, on its bottom side, with an outside 56. Outsole 56 is like previously described outsole 16.

As distinguished from the above-described embodiments of a running shoe (according to the invention), whereas differential firmness in these prior-described shoes is achieved through the utilization of slab-like components of different firmness to form a midsole, in midsole 54, firmness differentiation is achieved through providing a unitary homogeneous sole member, or web, 58, in the heel region of the shoe, with this member, on its medial side, having a plurality of substantially horizontally inwardly directed bores, such as bores 60. Fitted in bores 60 are cylindrical plugs, such as plugs 62, that have a firmness which is greater than that of the material forming member 58. As can be seen with reference to FIG. 7, midsole 54 includes an angled longitudinal midline axis 64 which is like previously mentioned axis 24 in midsole 12. Axis 54 includes a heel axis segment **64*a* which substantially bisects the heel region of the midsole. Bores 60 and 62 extend substantially from the medial side of the midsole to a vertical plane containing axis segment 64***a*.

One of the advantages of the construction illustrated in FIGS. 6 and 7 is that it offers a high degree of flexibility in forming shoes to accommodate the needs of different runners. More specifically, the preparation of a homogeneous midsole piece which includes bores to receive resilient plugs of differing firmnesses enables a selection to be made at the time that shoe is purchased of the appropriate plugs to suit a runner's requirements. Shoe 50 performs with all of the advantages described earlier with respect to the other shoe embodiments herein.

While several embodiments of the invention have been shown and described herein, it will be appreciated by those skilled in the art that variations and modifications may be made without departing from the spirit of the invention.

It is claimed and desired to secure by Letters Patent:

1. Sole means in a sports shoe for absorbing shock on impact, and for producing lateral foot stability when the shoe is used for running, said means comprising a heel section formed of a resilient material whose overall firmness on the inner side of a longitudinal heel midline axis is greater than that on the outer side of said midline axis, and a forefoot section formed of a resilient material whose overall firmness on the outer side of a longitudinal forefoot midline axis is substantially the same as that on the outer side of said heel midline axis in said heel section.

2. Sole means in the heel region of a sports shoe for absorbing shock on impact, and for producing lateral foot stability when the shoe is used for running, said means comprising a first elastomeric slab portion having one density and having its mass distributed primarily on the medial side of the midline axis in such heel region, and a second elastomeric slab portion having another density which is less than said first density and having its mass distributed primarily on the lateral side of said midline axis.

3. The sole means of claim 2, wherein said slab portions are located in a midsole for the shoe, and meet along a planar interface substantially containing said midline axis.

4. The sole means of claim 3, wherein, with the shoe in an operative position, the plane containing said interface is substantially vertical.

5. The sole means of claim 3, wherein, with the shoe in an operative position, the plane containing said interface slopes downwardly progressing toward the outer side of the shoe.

* * * * *